US008693715B2

(12) United States Patent
Secall et al.

(10) Patent No.: US 8,693,715 B2
(45) Date of Patent: Apr. 8, 2014

(54) HEARING ASSISTANCE SYSTEM AND METHOD

(75) Inventors: Marc Secall, Constatine (CH); Amre El-Hoiydi, Neuchâtel (CH); Rainer Platz, Colombier (CH); Doninique Aparicio, Cernier (CH); Timothée Jost, Auvernier (CH); Christoph Schmid, Zimmerwald (CH)

(73) Assignee: Phonak AG, Stäfa (CH)

( * ) Notice: Subject to any disclaimer, the term of this patent is extended or adjusted under 35 U.S.C. 154(b) by 42 days.

(21) Appl. No.: 13/508,825

(22) PCT Filed: Nov. 17, 2009

(86) PCT No.: PCT/EP2009/065338

§ 371 (c)(1),
(2), (4) Date: May 9, 2012

(87) PCT Pub. No.: WO2010/018235

PCT Pub. Date: Feb. 18, 2010

(65) Prior Publication Data

US 2012/0224732 A1 Sep. 6, 2012

(51) Int. Cl.
*H04R 25/00* (2006.01)

(52) U.S. Cl.
USPC ..... 381/315; 381/312; 381/331; 455/103

(58) Field of Classification Search
USPC ..... 381/315, 77–85, 312, 331; 455/41.3, 455/59, 103
See application file for complete search history.

(56) References Cited

U.S. PATENT DOCUMENTS

| | | | | |
|---|---|---|---|---|
| 6,418,300 | B1 | 7/2002 | Laurent | |
| 6,570,943 | B2 | 5/2003 | Goldston et al. | |
| 6,765,929 | B1 * | 7/2004 | Cupo et al. | 370/478 |
| 7,639,828 | B2 | 12/2009 | Platz | |
| 8,019,386 | B2 * | 9/2011 | Dunn et al. | 455/563 |
| 8,144,903 | B2 | 3/2012 | Haenggi et al. | |
| 8,422,705 | B2 * | 4/2013 | Kilsgaard | 381/315 |
| 2005/0100182 | A1 | 5/2005 | Sykes et al. | |
| 2006/0177081 | A1 | 8/2006 | Bauml et al. | |
| 2006/0274747 | A1 * | 12/2006 | Duchscher et al. | 370/389 |

(Continued)

FOREIGN PATENT DOCUMENTS

| | | | |
|---|---|---|---|
| DE | 37 18 906 | A1 | 12/1988 |
| DE | 197 17 169 | A1 | 10/1998 |

(Continued)

*Primary Examiner* — Curtis Kuntz
*Assistant Examiner* — Ryan Robinson
(74) *Attorney, Agent, or Firm* — Roberts Mlotkowski Safran & Cole, P.C.; David S. Safran

(57) ABSTRACT

A system for providing hearing assistance to at least one user, having: at least one audio signal source (16, 20) for providing audio signals; a transmission unit (10) for wireless transmission of audio signals; at least one receiver unit (12, 14) for wireless reception of audio signals from the transmission unit; a device (42, 82) for stimulating the hearing of the user according to audio signals supplied from the at least one receiver unit. The transmission unit has both an analog transmitter (26) for applying an analog modulation scheme and a digital transmitter (28) for applying a digital modulation scheme in order to transmit the audio signals from the audio signal source (16, 20) simultaneously via an analog audio link (34) and a digital audio link (40).

15 Claims, 2 Drawing Sheets

(56) References Cited

U.S. PATENT DOCUMENTS

| | | | | |
|---|---|---|---|---|
| 2007/0189561 | A1* | 8/2007 | Dijkstra et al. | 381/315 |
| 2009/0318082 | A1* | 12/2009 | Sinton et al. | 455/41.2 |
| 2010/0119093 | A1* | 5/2010 | Uzuanis et al. | 381/312 |
| 2011/0044481 | A1 | 2/2011 | Marquis et al. | |
| 2011/0150255 | A1* | 6/2011 | Solum | 381/315 |

FOREIGN PATENT DOCUMENTS

| | | | |
|---|---|---|---|
| EP | 1 863 320 | A1 | 12/2007 |
| KR | 2007-0089325 | A | 8/2007 |
| WO | 00/21228 | A1 | 4/2000 |
| WO | 2008/074350 | A1 | 6/2008 |
| WO | 2008/138365 | A1 | 11/2008 |

* cited by examiner

HEARING ASSISTANCE SYSTEM AND METHOD

BACKGROUND OF THE INVENTION

1. Field of the Invention

The invention relates to a system and a method for providing hearing assistance to at least one user, wherein audio signals from an audio signal source, such as a microphone for capturing a speaker's voice, are transmitted via a wireless link to a receiver unit, such as an audio receiver for a hearing aid, from where the audio signals are supplied to a means for stimulating the hearing of the user, such as a hearing aid speaker.

2. Description of Related Art

Usually in such systems the wireless audio link is an FM (frequency modulation) radio link. According to a typical application of such wireless audio systems, the receiver unit is connected to or integrated into a hearing instrument, such as a hearing aid, with the transmitted audio signals being mixed with audio signals captured by the microphone of the hearing instrument prior to being reproduced by the output transducer of the hearing instrument. The benefit of such systems is that the microphone of the hearing instrument can be supplemented or replaced by a remote microphone which produces audio signals which are transmitted wirelessly to the FM receiver, and thus, to the hearing instrument. In particular, FM systems have been standard equipment for children with hearing loss in educational settings for many years. Their merit lies in the fact that a microphone placed a few inches from the mouth of a person speaking receives speech at a much higher level than one placed several feet away. This increase in speech level corresponds to an increase in signal-to-noise ratio (SNR) due to the direct wireless connection to the listener's amplification system. The resulting improvements of signal level and SNR in the listener's ear are recognized as the primary benefits of FM radio systems, as hearing-impaired individuals are at a significant disadvantage when processing signals with a poor acoustical SNR.

A typical application of such wireless audio systems is at school, wherein the teacher uses a wireless microphone for transmitting the captured audio signals via the transmission unit to receiver units worn by the students. Since the receiver units and the respective hearing aids are usually owned by the students, the receiver units may be of different types within a class.

Another typical application of wireless audio systems is the case in which the transmission unit is designed as an assistive listening device. In this case, the transmission unit may include a wireless microphone for capturing ambient sound, in particular from a speaker close to the user, and/or a gateway to an external audio device, such as a mobile phone; here, the transmission unit usually only serves to supply wireless audio signals to the receiver unit(s) worn by the user.

Examples of analog wireless FM systems particularly suited for school applications are described, for example, in European Patent Application EP 1 863 320 A1 and International Patent Application Publication WO 2008/138365 A1, which corresponds to U.S. Patent Application Publication 2011/0044481 A1. According to these systems, the wireless link does not only serve to transmit audio signals captured by the wireless microphone, but in addition also serve to transmit control data obtained from analyzing the audio signals in the transmission unit to the receiver unit(s), with such control data being used in the receiver unit to adjust, for example, the gain applied to the received audio signals according to the prevailing ambient noise and the issue of whether the speaker is presently speaking or not. For transmission of such control data, the range between 5 and 7 kHz of the transmitted bandwidth, i.e., a frequency band above the audio signal band, may be used.

In applications where the receiver unit is part of or connected to a hearing aid, transmission is usually carried out by using analog FM technology in the 200 MHz frequency band. In recent systems, the analogue FM transmission technology may be replaced by employing digital modulation techniques for audio signal transmission. An example of such digital system is available from the company Comfort Audio AB, 30105 Halmstad, Sweden under the designation "Digisystem", (see the company website).

A specific example of an analog wireless FM system particularly suited for school applications is described in International Patent Application Publication WO 2008/074350 A1 which corresponds to U.S. Pat. No. 8,144,903 B2, wherein the system consists of a plurality of transmission units comprising a microphone and a plurality of analog FM receiver units and wherein only one of the transmission units has an analog audio signal transmitter, while each of the transmission units is provided with a digital transceiver in order to realize an assistive digital link for enabling communication between the transmission units. The assistive digital link also serves to transmit audio signals captured by a transmission unit not having the analog transmitter to the transmission unit having the analog transmitter from where the audio signals are transmitted via the analog FM link to the receiver units.

Digital audio signal transmission is also used in the field of mobile telephony, wherein it is known to provide a mobile telephone with the option to operate in different networks, for example GSM900 and GSM1800, including services like GPRS and EDGE, and UMTS, including services like HSDPA and HSUPA. However, at a time, always only one of these options is used, depending on the present network.

It is also known that special security relevant applications, such as navigation systems, flight and/or space communication systems and personal safety systems, may utilize redundant radio systems in order to improve robustness and to guarantee operation also in case of failure of one of the radio units. Naturally, always the same radio technology is used for the redundant link, and only one of the links is operated at the same time.

In radio broadcasting or TV broadcasting, it is known to transmit mixed analog and digital signals, see, for example, U.S. Pat. No. 6,418,300 B1, German Patent Application DE 37 18 906 A1, German Patent Application DE 197 17 169 A1 and International Patent Application WO 00/21228 A1 that corresponds to U.S. Pat. No. 6,570,943 B2.

SUMMARY OF THE INVENTION

It is an object of the invention to provide for a wireless audio system comprising a transmission unit which provides for particularly flexible operation.

This object is achieved by a hearing assistance system and a hearing assistance method as described below.

The invention is beneficial in that, by providing the transmission unit both with an analog transmitter and a digital transmitter to transmit the audio signals simultaneously via an analog audio link and a digital audio link, the transmission unit can be used both with analog receiver units and with digital receiver units, which is particularly unit and part of the students may use a digital receiver unit. In particular, the transmission unit thereby is compatible also with the large base of analog receiver units already existing on the market.

The invention is particularly useful for transmitting audio signals from a wireless microphone to one or more hearing aids, but it also may be used for transmitting audio signals from a wireless microphone or another audio signal source, such as a music player, a mobile phone or a TV (television) unit, to a hearing aid, a headphone or a loudspeaker, such as a speech enhancement system in a room for an audience.

These and further objects, features and advantages of the present invention will become apparent from the following description when taken in connection with the accompanying drawings which, for purposes of illustration only, show several embodiments in accordance with the present invention.

DETAILED DESCRIPTION OF THE INVENTION

Figure 1:
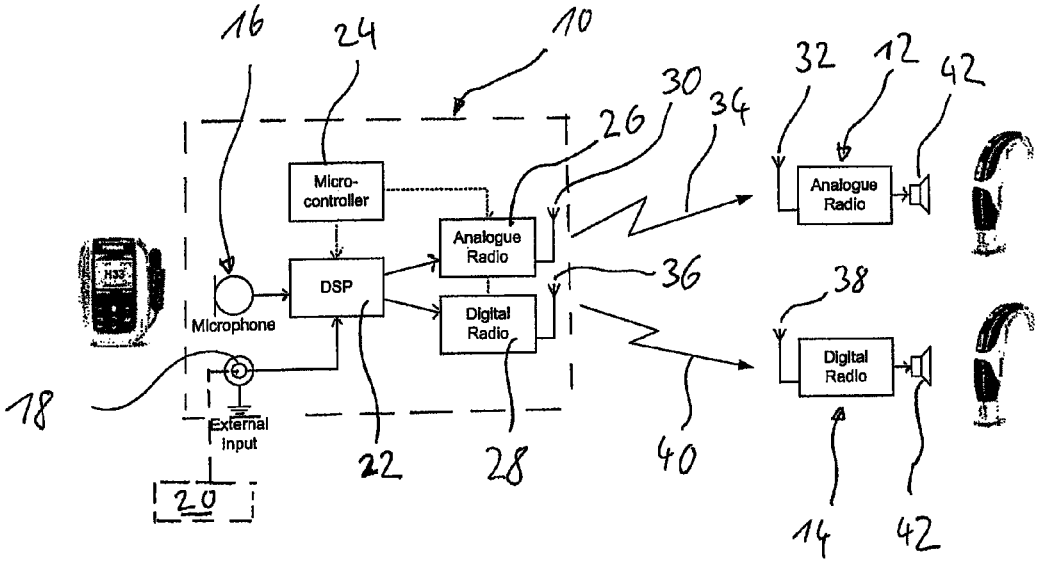
FIG. 1 is a schematic block diagram of an example of a hearing assistance system according to an invention.

A schematic block diagram of an example of a hearing assistance system according to the invention is shown in FIG. 1 which comprises a transmission unit 10 and at least one receiver unit wherein, in the embodiment of FIG. 1, an analog receiver unit 12 and a digital receiver unit 14 are shown.

The transmission unit 10 comprises a microphone arrangement 16 for capturing a speaker's voice, which may be integrated within the housing of the transmission unit 10 or which may be connected to it via a cable. The transmission unit 10 also may include an audio signal input 18 which serves to connect an external audio signal source 20, such as a mobile phone, an FM radio, a music player, a telephone or a TV device, to the transmission unit 10. The audio signals captured by the microphone arrangement 16 and the audio signals optionally received from the external audio signal source 20 are supplied to a digital signal processor (DSP) 22 which is controlled by a microcontroller 24 and which acts as an audio signal processing unit which applies, for example, a gain model to the captured audio signals.

In addition, the DSP 22 may serve to analyze the captured audio signals and to generate control data (control commands) according to the result of the analysis of the captured audio signals. The processed audio signals and the control data/commands are supplied in parallel both to an analog transmitter 26 and a digital transmitter 28, which are likewise controlled by the microcontroller 24. The analog transmitter 26 applies an analog modulation scheme, typically a frequency modulation scheme, to the processed audio signals, and the digital transmitter 28 applies a digital modulation scheme, such as phase shift keying (PSK), frequency shift keying (FSK), amplitude shift keying (ASK) or combined amplitude and phase modulations such as Quadrature Phase Shift Keying (QPSK), and variations thereof (e.g., Gaussian Frequency-Shift Keying (GFSK)) to the processed audio signals.

The analog transmitter 26 transmits the modulated signals via an antenna 30 to an antenna 32 of the analog receiver unit 12, thereby establishing an analog link 34. The digital transmitter 28 transmits the modulated signals via an antenna 36 to an antenna 38 of the digital receiver unit 14, thereby establishing a digital link 40. Each of the analog receiver unit 12 and the digital receiver unit 14 comprises or is connected to a loudspeaker 42 or another means for stimulating a user's hearing. Typically, the receiver units 12, 14 are ear-worn devices which are integrated into or connected to a hearing aid comprising the speaker 42. The control data transmitted in parallel to the audio signals may serve to control operation of the receiver units 12, 14 according to the presently prevailing auditory scene as detected by the DSP 22 from the audio signal captured by the microphone arrangement 16.

In practice, both the digital transmitter 28 and the digital receiver unit 14 are designed as transceivers, so that the digital transmitter 28 can also receive control data and commands sent from the digital receiver unit 14.

A typical carrier frequency range for the analog link 34 is around 200 MHz. Typical carrier frequencies for the digital link 40 are 865 MHz, 915 MHz and 2.45 GHz.

The microcontroller 24 is responsible for management of all transmitter components and may implement the wireless communication protocol, in particular for the digital link 40.

Figure 2:
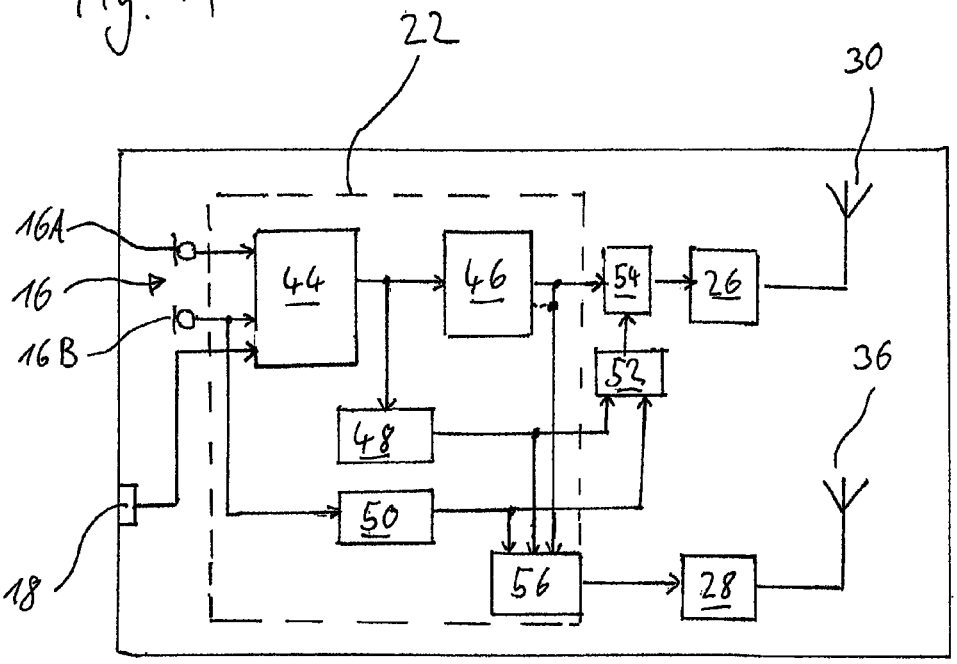
FIG. 2 is a more detailed example of the audio signal path in the transmission unit of the system of FIG. 1.

In FIG. 2, an example of the audio signal path in the transmission unit 10 is shown in more detail. The microphone arrangement 16 comprises two spaced apart microphones 16A, 16B for capturing audio signals which are supplied to an acoustic beam-former unit 44 which generates an output signal supplied to a gain model unit 46. The output of the beam-former unit 44 is also supplied to a voice activity detector (VAD) unit 48 which serves to detect whether the speaker is presently speaking or not and which generates a corresponding status output signal. The output of at least one of the microphones 16A, 16B is also supplied to an ambient noise estimation unit 50 which serves to estimate the ambient noise level and which generates a corresponding output signal.

The output signals of the units 48, 50 are supplied to an encoder unit 52 in which the data is encoded by a digital encoder/modulator, e.g., DTMF encoded, to produce control data, for example, within a range from 5 kHz to 7 kHz. The output of the unit 52 and the processed audio signals from the gain model 46 are supplied to an adder unit 54 in which the audio signals and the control data signals are mixed and are supplied as a mixed signal to the analog transmitter 26. The processed audio signals from the gain model unit 46 and the output signals of the units 48 and 50 are also applied to a unit 56 which serves to generate a corresponding digital signal which is supplied to the digital transmitter 28.

For analog transmission, the audio signals may be limited to a range of 100 Hz to 5 kHz. Since such a bandwidth limitation is not desirable in the audio signals for digital transmission, the audio signals for digital transmission may be processed in the unit 46 differently than the audio signals for analog transmission and may be delivered at a separate output (dashed line at the element 46 in FIG. 2).

The units 44, 46, 48, 50 and 56 may be functionally realized by the DSP 22 (see the dashed line surrounding these units in FIG. 2).

Figure 3:
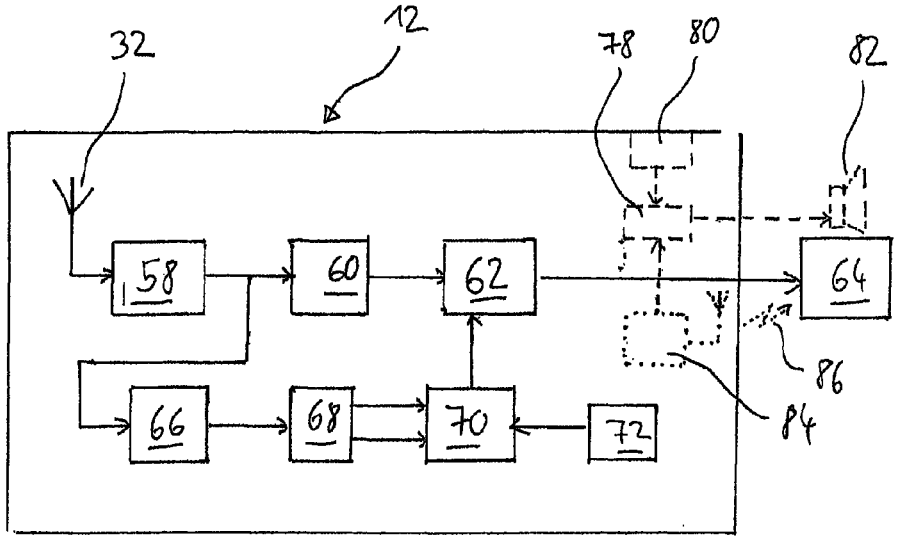
FIG. 3 is a more detailed block of diagram an example of the analog receiver unit of the system of FIG. 1.

A more detailed example of the analog receiver unit 12 is shown in FIG. 3, according to which the audio signals transmitted via the analog link 34 are received by the antenna 32 and are demodulated in an FM radio receiver 58. An audio signal low-path filter 60, operating at 5 kHz, applies the audio signals to a variable gain amplifier 62 which controls the gain of the analog audio signal and from where the amplified audio signals are supplied to a hearing aid 64. The output signal of the FM radio receiver 58 is also filtered by a high pass filter 66 operating at 5 kHz in order to extract the control data from the unit 52 contained in the FM radio signal. The filtered signal is applied to a decoder unit 68 including a DTMF decoder and a digital demodulator/decoder in order to decode the data signals from the units 48, 50 of the transmission unit 10.

The control data decoded in the unit 68 are provided separately to a parameter update unit 70 in which the parameters of the commands are updated according to information stored in an EEPROM 72 of the receiver unit 12. The output of the parameter update unit 70 is used to control the variable gain amplifier 62 which is gain-controlled. Thereby, the audio signal output of the amplifier 62—and thus, the sound pressure level at which the audio signals are finally reproduced—can be controlled according to the result of the auditory scene analysis performed by the transmission unit 10.

Figure 4:
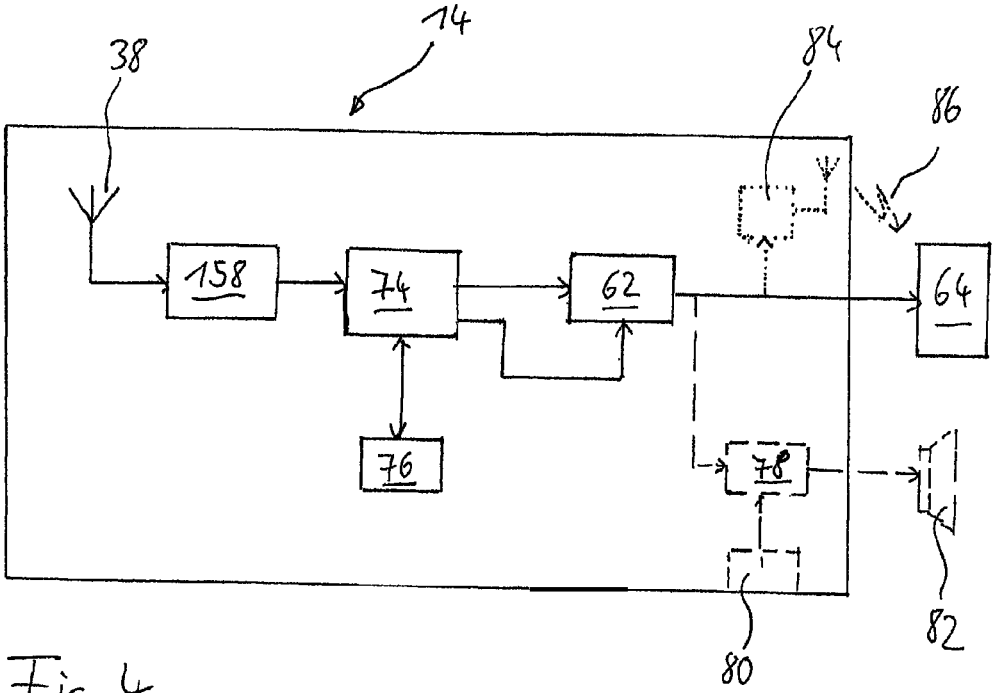
FIG. 4 is a more detailed block diagram of an example of the digital receiver unit of the system of FIG. 1.

A more detailed example of the digital receiver unit 14 is shown in FIG. 4, according to which the signals transmitted via the digital link 40 are received by the antenna 38 and are demodulated in a digital radio receiver 158. The demodulated signals are supplied to a DSP 74 which separates the signals into the audio signals and the control data and which is provided for advanced processing, e.g., equalization, of the audio signals according to the information provided by the control data. The processed audio signals, after digital-to-analog conversion, are supplied to a variable gain amplifier 62 which serves to amplify the audio signals by applying a gain controlled by the control data received via the digital link 40. Alternatively, the variable gain amplifier may be realized in digital form by having a PWM modulator take over the role of the D/A-converter and the power amplifier. The amplified audio signals are supplied to a hearing aid 64. The receiver unit 14 also includes a memory 76 for the DSP 74.

Rather than supplying the audio signals amplified by the variable gain amplifier 62 to the audio input of a hearing aid 64, the receiver units 12, 14 may include a power amplifier 78 which may be controlled by a manual volume control 80 and which supplies power amplified audio signals to a loudspeaker 82 which may be an ear-worn element integrated within or connected to the receiver unit 12, 14. Volume control also could be performed remotely from the transmission unit 10 or the transmission unit 110 by transmitting corresponding control commands to the receiver units 12, 14.

Alternatively, rather than being ear-worn components, the receiver units 12, 14 could be located somewhere in a room in order to supply audio signals to loudspeakers 82 installed in the same room, whereby a speech enhancement system for an audience can be realized (as indicated by dashed lines in FIGS. 3 and 4).

Another alternative implementation of the receiver maybe a neck-worn device having a transmitter 84 for transmitting the received signals via with an magnetic induction link 86 (analog or digital) to the hearing aid 64 (as indicated by dotted lines in FIGS. 3 and 4)

Examples regarding the implementation of the analog part of the hearing assistance system of the present invention can be found in European Patent Application EP 1 863 320 A1 and International Patent Application Publication WO 2008/138365 A1, which corresponds to U.S. Patent Application Publication 2011/0044481 A1 which are cited above. It is noted that the transmission unit 10 would not necessarily require a DSP for processing the input signals. Alternatively, the role of the microcontroller 24 could also be taken over by the DSP 22. Also, signal transmission could be limited to a pure audio signal, without adding control and command data.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as encompassed by the scope of the appended claims.

The invention claimed is:

1. A system for providing hearing assistance to at least one user, comprising:

at least one audio signal source for providing audio signals;

a transmission unit for wireless transmission of audio signals;

at least one receiver unit for wireless reception of audio signals from the transmission unit;

means for stimulating hearing of the user according to audio signals supplied from the at least one receiver unit, wherein the transmission unit comprises both an analog transmitter for applying an analog modulation scheme and a digital transmitter for applying a digital modulation scheme to the audio signals from the audio signal source and for simultaneously transmitting the audio signals via an analog audio link and a digital audio link, and wherein at least one of the receiver units comprises a digital receiver for receiving audio signals from the digital transmitter and at least one of the receiver units comprises an analog receiver for receiving audio signals from the analog transmitter, said analog and digital receivers both being operable at the same time to receive the audio signals simultaneously transmitted via analog and digital audio links, respectively.

2. The system of claim 1, wherein the audio signal source is a microphone arrangement integrated into or connected to the transmission unit for capturing a speaker's voice.

3. The system of claim 2, wherein the transmission unit comprises an audio signal processing unit for processing the audio signals captured by the microphone arrangement prior to being transmitted.

4. The system of claim 3, wherein the audio signal processing unit is adapted for applying a gain model to the captured audio signals.

5. The system of claim 2, wherein the transmission unit comprises means for analyzing the captured audio signals and for generating, according to analysis of the captured audio signals, control data to be transmitted both via the analog link and the digital link together with the audio signals to the at least one receiver unit.

6. The system of claim 5, wherein the transmission unit comprises at least one of an acoustic beam former unit, a voice activity detector unit and an ambient noise estimation unit.

7. The system of claim 1, wherein the analog transmitter is an FM transmitter.

8. The system of claim 1, wherein the digital transmitter is adapted to use at least one of phase shift keying (PSK), frequency shift keying (FSK), amplitude shift keying (ASK) or combined amplitude and phase modulations.

9. The system of claim 1, wherein the transmission unit comprises a microcontroller for controlling both the analog transmitter and the digital transmitter.

10. The system of claim 1, wherein the transmission unit is connected to an audio device from the group comprising a mobile phone, an FM radio, a music player, a telephone, and a TV device, as an external audio signal source.

11. The system of claim 5, wherein each receiver unit comprises a variable gain amplifier controlled by the control data received from the transmission unit.

12. The system of claim 1, wherein the at least one receiver unit is connected to or integrated into an ear-worn device comprising the stimulation means.

13. The system of claim 1, wherein the at least one receiver unit is a neck-worn device comprising a transmitter for transmitting audio signals via an inductive link to an ear-worn device comprising the stimulation means.

14. The system of claim 1, wherein the at least one receiver unit is connected to or integrated within at least one audience loudspeaker serving as the stimulation means.

15. A method for providing hearing assistance to at least one user, comprising the steps of:

providing audio signals from at least one audio signal source to a transmission unit, transmitting audio signals wirelessly from the transmission unit to at least one receiver unit, stimulating hearing of the at least one user according to audio signals supplied from the at least one receiver unit, wherein the transmission unit comprises both an analog transmitter applying an analog modulation scheme and a digital transmitter applying a digital modulation scheme to the audio signals, said transmitting step comprising transmitting of the audio signals from the audio signal source simultaneously via an analog audio link and a digital audio link, and wherein at least one of the receiver units comprises a digital receiver for receiving audio signals from the digital transmitter and at least one of the receiver units comprises an analog receiver for receiving audio signals from the analog transmitter, said analog and digital receivers being operated at the same time for receiving the audio signals simultaneously transmitted via the analog and digital audio links, respectively.

* * * * *